US009119419B2

(12) United States Patent
Sebastian et al.

(10) Patent No.: US 9,119,419 B2
(45) Date of Patent: Sep. 1, 2015

(54) FILTER MATERIAL FOR A FILTER ELEMENT OF A SMOKING ARTICLE, AND ASSOCIATED SYSTEM AND METHOD

(71) Applicant: R. J. Reynolds Tobacco Company, Winston-Salem, NC (US)

(72) Inventors: Andries D. Sebastian, Clemmons, NC (US); Evon Llewellyn Crooks, Mocksville, NC (US); Jason Kobisky, Winston-Salem, NC (US); Cortney R. Jackson, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 13/648,756

(22) Filed: Oct. 10, 2012

(65) Prior Publication Data

US 2014/0096783 A1 Apr. 10, 2014

(51) Int. Cl.

| | |
|---|---|
| ***A24D 3/06*** | (2006.01) |
| ***A24D 3/02*** | (2006.01) |
| ***A24D 3/10*** | (2006.01) |

(52) U.S. Cl.

CPC ..... *A24D 3/0204* (2013.01); *A24D 3/068* (2013.01); *A24D 3/10* (2013.01)

(58) Field of Classification Search

CPC ..... A24D 3/065; A24D 3/068

See application file for complete search history.

(56) References Cited

U.S. PATENT DOCUMENTS

| | | | | |
|---|---|---|---|---|
| 2,728,112 | A | | 12/1955 | Berker |
| 3,119,396 | A | | 1/1964 | Tanquary |
| 3,144,025 | A | | 8/1964 | Erlich |
| 3,224,453 | A | | 12/1965 | Mahoney et al. |
| 3,319,629 | A | | 5/1967 | Chamberlain |
| 3,413,982 | A | | 12/1968 | Sublett et al. |
| 3,424,172 | A | | 1/1969 | Neurath |
| 3,571,870 | A | | 3/1971 | Dixon et al. |
| 3,658,626 | A | | 4/1972 | Berger et al. |
| 3,904,577 | A | | 9/1975 | Buisson |
| 4,085,760 | A | * | 4/1978 | Toyoshima et al. ..... 131/345 |
| 4,195,649 | A | | 4/1980 | Noguchi et al. |
| 4,237,274 | A | | 12/1980 | Leoni et al. |
| 4,252,766 | A | | 2/1981 | Baldini et al. |
| 4,261,373 | A | * | 4/1981 | Tamaoki et al. ..... 131/332 |
| 4,268,666 | A | | 5/1981 | Baldini et al. |

(Continued)

FOREIGN PATENT DOCUMENTS

| | | |
|---|---|---|
| WO | WO 95/24520 | 9/1995 |
| WO | WO 2009/000453 A2 | 12/2008 |
| WO | WO 2009/093051 | 7/2009 |

OTHER PUBLICATIONS

Puls et al., "Degradation of Cellulose Acetate-Based Materials: A Review," *J Polym Environ*, 2011, pp. 152-165, vol. 19.

*Primary Examiner* — Richard Crispino
*Assistant Examiner* — Eric Yaary
(74) *Attorney, Agent, or Firm* — Womble Carlyle Sandridge & Rice, LLP

(57) ABSTRACT

A method and associated system are provided for forming a biodegradable filter material for a filter element of a smoking article, wherein the method involves combining cellulose acetate fibers with regenerated cellulose fibers, drawing the combined cellulose acetate fibers and regenerated cellulose fibers to form drawn combined fibers, and crimping the drawn combined fibers to form a mixed fiber tow. An associated filter material for the filter element of a smoking article is also provided.

16 Claims, 6 Drawing Sheets

(56) References Cited

U.S. PATENT DOCUMENTS

| | | | | |
|---|---|---|---|---|
| 4,281,671 | A | 8/1981 | Bynre et al. | |
| 4,388,256 | A | 6/1983 | Ishida et al. | |
| 4,535,028 | A | 8/1985 | Yokogi et al. | |
| 4,811,745 | A | 3/1989 | Cohen et al. | |
| 4,925,602 | A | 5/1990 | Hill et al. | |
| 5,025,538 | A | 6/1991 | Saleh | |
| 5,225,277 | A | 7/1993 | Takegawa et al. | |
| 5,271,419 | A | 12/1993 | Arzonico et al. | |
| 5,275,859 | A | 1/1994 | Phillips et al. | |
| 5,387,285 | A | 2/1995 | Rivers | |
| 5,441,689 | A | 8/1995 | Laity | |
| 5,453,144 | A | 9/1995 | Kauffman et al. | |
| 5,478,386 | A | 12/1995 | Itoh et al. | |
| 5,622,190 | A | 4/1997 | Arterbery et al. | |
| 5,709,227 | A | 1/1998 | Arzonico et al. | |
| 5,746,230 | A * | 5/1998 | Arterbery et al. | 131/331 |
| 5,783,505 | A | 7/1998 | Duckett et al. | |
| 5,911,224 | A | 6/1999 | Berger | |
| 5,913,311 | A | 6/1999 | Ito et al. | |
| 5,947,126 | A * | 9/1999 | Wilson et al. | 131/331 |
| 5,970,988 | A | 10/1999 | Buchanan et al. | |
| 5,997,790 | A | 12/1999 | Vos et al. | |
| 6,062,228 | A | 5/2000 | Loercks et al. | |
| 6,080,457 | A | 6/2000 | Charlton et al. | |
| 6,087,465 | A | 7/2000 | Seppala et al. | |
| 6,344,239 | B1 * | 2/2002 | Asai et al. | 427/212 |
| 6,571,802 | B1 | 6/2003 | Yamashita | |
| 6,595,217 | B1 | 7/2003 | Case et al. | |
| 6,739,344 | B2 | 5/2004 | Yamashita | |
| 6,984,631 | B2 | 1/2006 | Aranishi et al. | |
| 7,435,208 | B2 | 10/2008 | Garthaffner | |
| 7,484,511 | B2 | 2/2009 | Jupe et al. | |
| 8,177,938 | B2 | 5/2012 | Sumnicht | |
| 2002/0096300 | A1 * | 7/2002 | Yamashita | 162/331 |
| 2003/0200973 | A1 | 10/2003 | Xue et al. | |
| 2003/0213496 | A1 | 11/2003 | Wolff et al. | |
| 2005/0011529 | A1 | 1/2005 | Horn et al. | |
| 2006/0201524 | A1 | 9/2006 | Zhang et al. | |
| 2006/0231113 | A1 | 10/2006 | Newbery et al. | |
| 2007/0143976 | A1 | 6/2007 | Sommer | |
| 2007/0235049 | A1 * | 10/2007 | Gedevanishvili et al. | 131/331 |
| 2008/0029118 | A1 | 2/2008 | Nelson et al. | |
| 2008/0295852 | A1 | 12/2008 | Riepert et al. | |
| 2009/0032037 | A1 * | 2/2009 | Xue et al. | 131/332 |
| 2009/0151738 | A1 | 6/2009 | Robertson et al. | |
| 2009/0288667 | A1 | 11/2009 | Andresen et al. | |
| 2009/0288669 | A1 | 11/2009 | Hutchens | |
| 2009/0288672 | A1 | 11/2009 | Hutchens | |
| 2010/0236561 | A1 | 9/2010 | Barnes et al. | |
| 2010/0294288 | A1 | 11/2010 | Sampson et al. | |
| 2011/0023900 | A1 | 2/2011 | Clarke et al. | |
| 2011/0030708 | A1 * | 2/2011 | Cui et al. | 131/332 |
| 2011/0036366 | A1 * | 2/2011 | Sebastian | 131/332 |
| 2011/0244499 | A1 | 10/2011 | Realff et al. | |
| 2011/0247609 | A1 | 10/2011 | Bansal et al. | |
| 2012/0000477 | A1 | 1/2012 | Sebastian et al. | |
| 2012/0000479 | A1 | 1/2012 | Sebastian et al. | |
| 2012/0000480 | A1 | 1/2012 | Sebastian et al. | |
| 2012/0017925 | A1 | 1/2012 | Sebastian et al. | |
| 2012/0024304 | A1 | 2/2012 | Sebastian | |
| 2013/0025610 | A1 | 1/2013 | Sebastian | |

* cited by examiner

FILTER MATERIAL FOR A FILTER ELEMENT OF A SMOKING ARTICLE, AND ASSOCIATED SYSTEM AND METHOD

BACKGROUND OF THE DISCLOSURE

1. Field of the Disclosure

The present disclosure relates to products made or derived from tobacco or other smokable material that are intended for human consumption. In particular, the disclosure relates to filter material for filter elements of smoking articles, such as cigarettes, and related methods for producing such filter material and associated filter elements.

2. Description of Related Art

Popular smoking articles, such as cigarettes, can have a substantially cylindrical rod-shaped structure and can include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap," and the filter element is attached to one end of the tobacco rod using a circumscribing wrapping material known as "tipping material." It also can be desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The currently available filter technology for forming filter elements may have several drawbacks. For example, conventional filter elements comprising a cellulose acetate tow, although being characterized as biodegradable, may require an undesirably long time to actually biodegrade. In some instances, the biodegradation period may be on the order of two to ten years. In response, alternate filter materials have been proposed, such as gathered paper, nonwoven polypropylene web or gathered strands of shredded web. However, even if filter elements comprising such alternate materials exhibit accelerated biodegradability over conventional cellulose acetate tow filter elements, the effect thereof on the mainstream smoke may not meet the expectations of the smoker. That is, conventional cellulose acetate tow is generally plasticized with an appropriate plasticizer, such as triacetin, upon the tow being bloomed and formed into the filter rod from which the filter elements are obtained. In this regard, the triacetin plasticizer provides a particular effect on the mainstream smoke (i.e., taste) that is pleasant to the smoker or has otherwise become expected by the smoker. One issue with alternate filter materials is that those materials may not necessarily blend with or suitably receive a plasticizer such as triacetin. That is, even if such alternate filter materials receive the triacetin, the effect of the combination on the mainstream smoke, for example, the taste of the smoke, may not be pleasant to the smoker or otherwise be similar enough to the sensation expected by the smoker who is accustomed to the organoleptic properties associated with triacetin-treated cellulose acetate tow filter elements.

Certain filter elements for cigarettes have been developed which contain materials that may promote biodegradation of filter elements following use. For example, certain additives have been noted (e.g., water soluble cellulose materials, water soluble fiber bonding agents, starch particles, photoactive pigments, and/or phosphoric acid) which can be added to filter materials to enhance degradability. See, for example, U.S. Pat. No. 5,913,311 to Ito et al.; U.S. Pat. No. 5,947,126 to Wilson et al.; U.S. Pat. No. 5,970,988 to Buchanan et al.; and U.S. Pat. No. 6,571,802 to Yamashita; and US Pat. Appl. Publ. Nos. 2009/0151735 to Robertson and 2011/0036366 to Sebastian. In some cases, conventional cellulose acetate filter material has been replaced with other materials, such as moisture disintegrative sheet materials, extruded starch materials, or polyvinyl alcohol. See U.S. Pat. No. 5,709,227 to Arzonico et al; U.S. Pat. No. 5,911,224 to Berger; U.S. Pat. No. 6,062,228 to Loercks et al.; and U.S. Pat. No. 6,595,217 to Case et al. It has also been suggested that the incorporation of slits into a filter element may enhance biodegradability, as described in U.S. Pat. No. 5,947,126 to Wilson et al. and U.S. Pat. No. 7,435,208 to Garthaffner. Biodegradability has also been proposed to be imparted by use of certain adhesives, such as described in U.S. Pat. No. 5,453,144 to Kauffman et al. and US Pat. Appl. Publ. 2012/0000477 to Sebastian et al. Another possible means for enhancing biodegradability is replacing the conventional cellulose acetate filter material with a core of a fibrous or particulate cellulose material coated with a cellulose ester, as described in U.S. Pat. No. 6,344,349 to Asai et al.

Further advancements in filter elements and apparatuses and methods for producing the same may be desirable, wherein such advancements maximize or otherwise enhance the biodegradability of the filter tow/filter element, while blending with conventional plasticizers to retain the sensory effects on the mainstream smoke (i.e., smoke taste), expected by the smoker.

SUMMARY OF THE DISCLOSURE

The above and other needs are met by aspects of the present disclosure which, in one aspect provides a method of forming a mixed fiber tow for a filter element of a smoking article. The invention, in certain embodiments, provides a mixed fiber tow suitable for use in filter elements of smoking articles that exhibits enhanced biodegradability as compared to conventional cigarette filters, while still providing the desirable taste and filtration properties associated with conventional cigarette filters.

In one aspect, the invention provides a method for forming a mixed fiber tow suitable for use in a filter element for a smoking article, the method comprising combining a first plurality of cellulose acetate fibers with a second plurality of fibers comprising a polymeric material different from the first plurality of fibers (e.g., regenerated cellulose fibers) to form a mixed fiber blend; drawing the mixed fiber blend to reduce the denier per filament of the fibers of the mixed fiber blend and form a drawn fiber blend; and crimping the drawn fiber blend to form a mixed fiber tow. The weight ratio of the two fiber types can vary, but typically the weight ratio of the first plurality of cellulose acetate fibers to the second plurality of fibers is about 25:75 to about 75:25. The method can include further steps, such as incorporating the mixed fiber tow into a filter element suitable for use in a smoking article, which will typically entail one or more of blooming the mixed fiber tow and applying a plasticizer to the mixed fiber tow.

The first plurality of cellulose acetate fibers and the second plurality of fibers are typically undrawn or partially drawn prior to said combining step so that the fibers will not have a tendency to break during the subsequent drawing step. The arrangement of the two fiber types within the mixed fiber blend can vary. In certain embodiments, the longitudinal axes of the first plurality of cellulose acetate fibers and the second plurality of fibers in the mixed fiber blend are disposed substantially parallel to each other. In another embodiment, the fibers of the mixed fiber blend are arranged such that the fibers of the first plurality of cellulose acetate fibers and the fibers of the second plurality of fibers are one of alternatingly disposed and substantially uniformly interspersed with respect to each other, over a cross-section of the mixed fiber blend. In yet another embodiment, the fibers of the mixed fiber blend are arranged such that one of the first plurality of cellulose acetate fibers and the second plurality of fibers is arranged to form a central core and the other of the first plurality of cellulose acetate fibers and the second plurality of fibers is arranged perimetrically about the central core, with respect to a cross-section of the mixed fiber blend.

Where a degradable filter element is desired, the second plurality of fibers can comprise a degradable polymeric material, such as aliphatic polyesters (e.g., polylactic acid or a polyhydroxyalkanoate), cellulose, regenerated cellulose, cellulose acetate with imbedded starch particles, cellulose coated with acetyl groups, polyvinyl alcohol, starch, aliphatic polyurethanes, polyesteramides, cis-polyisoprene, cis-polybutadiene, polyanhydrides, polybutylene succinate, proteins, alginate, and copolymers and blends thereof.

The mixed fiber tow typically has a total denier in the range of about 20,000 denier to about 80,000 denier, such as about 30,000 denier to about 60,000 denier. Further, the mixed fiber tow typically has a dpf in the range of about 3 to about 5.

In another aspect of the invention, a method for forming a filter element for a smoking article is provided, the method comprising receiving a mixed fiber tow comprising a blend of a first plurality of drawn and crimped cellulose acetate fibers and a second plurality of drawn and crimped fibers comprising a polymeric material different from the first plurality of fibers, the mixed fiber tow having a total denier in the range of from about 20,000 denier to about 80,000 denier; and processing the mixed fiber tow to provide a filter element suitable for incorporation into a smoking article (e.g., blooming the mixed fiber tow and/or applying a plasticizer to the mixed fiber tow and/or circumscribing the mixed fiber tow with plug wrap). The mixed fiber tow used in this aspect of the invention can have any of the characteristics noted above.

Another aspect of the disclosure provides a filter element suitable for use in a smoking article, the filter element comprising a mixed fiber tow comprising a blend of a first plurality of drawn and crimped cellulose acetate fibers and a second plurality of drawn and crimped fibers comprising a polymeric material different from the first plurality of fibers, the mixed fiber tow having a total denier in the range of from about 20,000 denier to about 80,000 denier. The mixed fiber tow of the filter element can have any of the characteristics noted herein. In certain embodiments, the filter element of the invention exhibits a degradation rate that is at least about 50% faster than that of a traditional cellulose acetate filter element. The fibers of the mixed fiber tow of the filter element are typically arranged such that the fibers of the first plurality of cellulose acetate fibers and the fibers of the second plurality of fibers are one of alternatingly disposed and substantially uniformly interspersed with respect to each other, over a cross-section of the mixed fiber tow. Alternatively, the fibers of the mixed fiber tow of the filter element are arranged such that one of the first plurality of cellulose acetate fibers and the second plurality of fibers is arranged to form a central core and the other of the first plurality of cellulose acetate fibers and the second plurality of fibers is arranged perimetrically about the central core, with respect to a cross-section of the mixed fiber tow. In certain embodiments, the hardness of the filter element will be at least about 90% or at least about 92% or at least about 94%. Additionally, in certain advantageous embodiments, the mixed fiber tow will include at least about 50% by weight of the first plurality of cellulose acetate fibers (e.g., at least about 60% or at least about 70% by weight of the first plurality of cellulose acetate fibers).

In yet another aspect, the invention provides a cigarette or other smoking article comprising a rod of smokable material and a filter element according to any embodiment set forth herein.

A further aspect of the disclosure provides a system for forming a filter material for a filter element of a smoking article. Such a system can comprise a combining unit configured to combine a first plurality of cellulose acetate fibers with a second plurality of fibers comprising a polymeric material different from the first plurality of fibers to form a mixed fiber blend; a drawing unit configured to receive and draw the mixed fiber blend to form a drawn fiber blend; and a crimping unit configured to receive and crimp the drawn fiber blend to form a mixed fiber tow. In certain embodiments, the combining unit is configured to combine cellulose acetate fibers with regenerated cellulose fibers, such that longitudinal axes thereof are disposed substantially parallel to each other in forming a mixed fiber blend. In some embodiments, the combining unit is configured to combine cellulose acetate fibers with regenerated cellulose fibers such that the cellulose acetate fibers and regenerated cellulose fibers are one of alternatingly disposed and substantially uniformly interspersed with respect to each other, over a cross-section of the mixed fiber blend. In still further embodiments, the combining unit is configured to combine cellulose acetate fibers with regenerated cellulose fibers such that one of the cellulose acetate fibers and regenerated cellulose fibers is arranged to form a central core and the other of the cellulose acetate fibers and regenerated cellulose fibers is arranged perimetrically about the central core, with respect to a cross-section of the mixed fiber blend. If desired, the drawing unit can be configured to draw the mixed fiber blend such that the drawn fiber blend has a dpf in the range of about 3 to about 5. The system can also include a blooming unit configured to bloom the mixed fiber tow.

Aspects of the present disclosure can thus provide a biodegradable filter tow made by blending undrawn or partially drawn cellulose acetate fibers and regenerated cellulose fibers, then subjecting the combined fibers to a drawing step, and then crimping the mixed fiber bundle to generate a mixed fiber tow. The ratio of the cellulose acetate fibers and regenerated cellulose fibers can be optimized to maximize biodegradability of the mixed fiber tow, while retaining the ability to plasticize bloomed tow, for example, with triacetin, such that the filter retains the desirable smoke taste.

The above and other aspects thus address the identified needs and provide advantages as otherwise detailed herein.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DISCLOSURE

The present disclosure now will be described more fully hereinafter with reference to the accompanying drawings, in which some, but not all aspects of the disclosure are shown. Indeed, this disclosure may be embodied in many different forms and should not be construed as limited to the aspects set forth herein; rather, these aspects are provided so that this disclosure will satisfy applicable legal requirements. Like numbers refer to like elements throughout.

Figure 1:
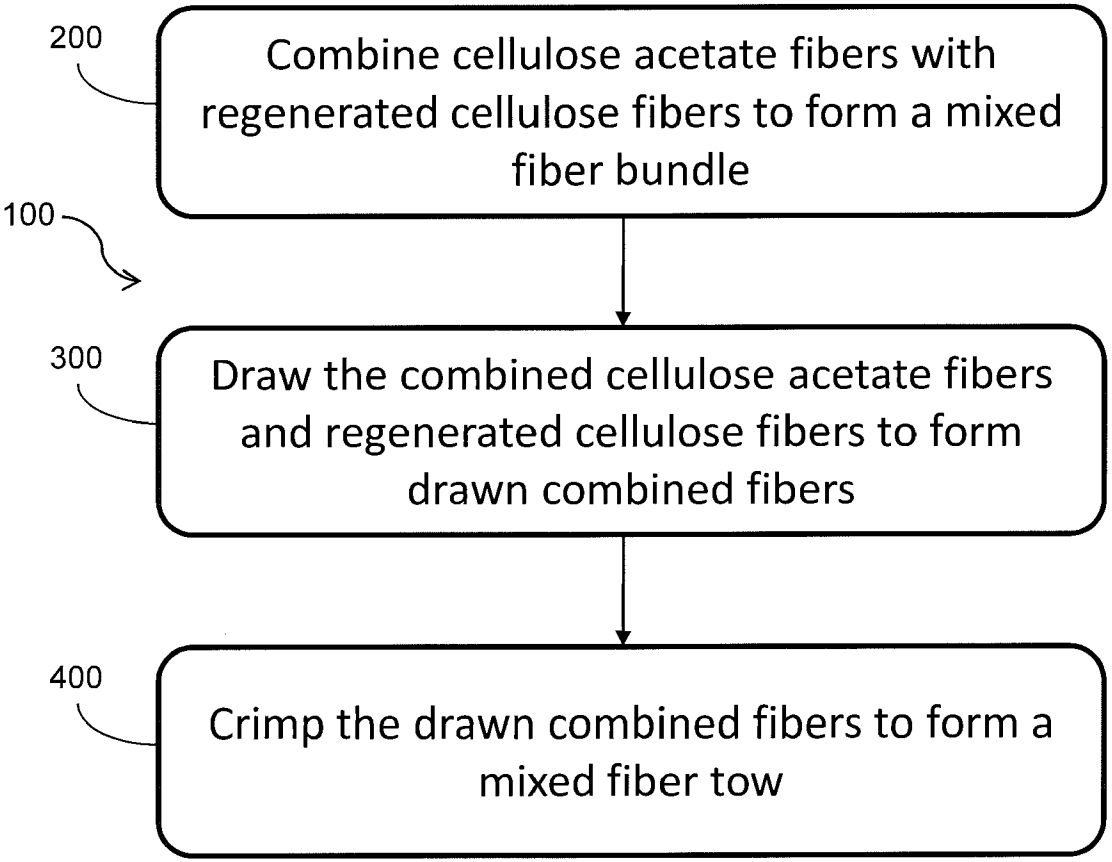
FIG. 1 is a schematic illustration of a method of forming a biodegradable filter material for a filter element of a smoking article, according to one aspect of the present disclosure.

FIG. 1 schematically illustrates a process or method of forming a biodegradable filter material for a filter element of a smoking article, generally indicated by the element 100, according to one aspect of the present disclosure. Such an aspect can involve, for example, combining cellulose acetate fibers with dissimilar fibers (e.g., regenerated cellulose fibers), collectively referred to herein as the fiber inputs, to form a mixed fiber bundle or blend (element 200). Further processing of the mixed fiber bundle can include drawing the combined cellulose acetate fibers and regenerated cellulose fibers to form drawn combined fibers (i.e., a drawn fiber blend, element 300), and crimping the drawn fiber blend to form a mixed fiber tow (element 400).

The cellulose acetate fibers used in the present invention can be fibrous materials conventionally used to form fibrous tows for cigarettes. Cellulose acetate fibers are commercially available from, for example, Eastman Chemical Company. The first step in conventional cellulose acetate fiber formation is esterifying a cellulose material. Cellulose is a polymer formed of repeating units of anhydroglucose. Each monomer unit has three hydroxyl groups available for ester substitution (e.g., acetate substitution). Cellulose esters can be formed by reacting cellulose with an acid anhydride. To make cellulose acetate, the acid anhydride is acetic anhydride. Cellulose pulp from wood or cotton fibers is typically mixed with acetic anhydride and acetic acid in the presence of an acid catalyst such as sulfuric acid. The esterification process of cellulose will often result in essentially complete conversion of the available hydroxyl groups to ester groups (e.g., an average of about 2.9 ester groups per anhydroglucose unit). Following esterification, the polymer is typically hydrolyzed to drop the degree of substitution (DS) to about 2 to about 2.5 ester groups per anhydroglucose unit. The resulting product is typically produced in flake form that can be used in subsequent processing. To form a fibrous material, the cellulose acetate flake is typically dissolved in a solvent (e.g., acetone, methanol, methylene chloride, or mixtures thereof) to form a viscous solution. The concentration of cellulose acetate in the solution is typically about 15 to about 35 percent by weight. Additives such as whitening agents (e.g., titanium dioxide) can be added to the solution if desired. The resulting liquid is sometimes referred to as a liquid "dope." The cellulose acetate dope is spun into filaments using a melt-spinning technique, which entails extruding the liquid dope through a spinerette. The filaments pass through a curing/drying chamber, which solidifies the filaments prior to collection.

In some embodiments, as noted above, the fibers blended with the cellulose acetate fibers comprise cellulose (e.g., rayon). Cellulose can be natural or processed. In certain embodiments, cellulose as used herein may refer to regenerated cellulose fibers. Regenerated cellulose fibers are typically prepared by extracting non-cellulosic compounds from wood, contacting the extracted wood with caustic soda, followed by carbon disulfide and then by sodium hydroxide, giving a viscous solution. The solution is subsequently forced through spinneret heads to create viscous threads of regenerated fibers. Exemplary methods for the preparation of regenerated cellulose are provided in U.S. Pat. No. 4,237,274 to Leoni et al; U.S. Pat. No. 4,268,666 to Baldini et al; U.S. Pat. No. 4,252,766 to Baldini et al.; U.S. Pat. No. 4,388,256 to Ishida et al.; U.S. Pat. No. 4,535,028 to Yokogi et al.; U.S. Pat. No. 5,441,689 to Laity; U.S. Pat. No. 5,997,790 to Vos et al.; and U.S. Pat. No. 8,177,938 to Sumnicht, which are incorporated herein by reference. The manner in which the regenerated cellulose is made is not limiting, and can include, for example, both the rayon and the TENCEL® processes. Various suppliers of regenerated cellulose are known, including Lenzing (Austria), Cordenka (Germany), Aditya Birla (India), and Daicel (Japan). For use in the present invention, cellulose fibers in certain embodiments are advantageously treated to provide a secondary finish that imparts acetyl functionality to the fiber surface. Coated cellulose fibers can be provided, for example, using methods as outlined in US Pat. Appl. Pub. Nos. 2012/0017925; 2012/0000480; and 2012/0000479, all to Sebastian et al, which are incorporated herein by reference. See, also, U.S. Pat. No. 4,085,760 to Toyoshima The combination of cellulose acetate and cellulose fibers is particularly beneficial as the biodegradation rate of cellulose acetate and cellulose fibers has been shown to be greater than the sum of individual fiber degradation rates (i.e., the mixture biodegrades in a synergistic fashion). See U.S. Pat. No. 5,783,505 to Ducket et al., which is incorporated herein by reference.

The fiber inputs to the process of the invention (e.g., the cellulose acetate fibers and the regenerated cellulose fibers) are typically in continuous filament form and can have varying denier per filament, i.e., "dpf". Denier per filament is a measurement of the weight per unit length of the individual filaments of the fibers and can be manipulated to achieve a desired pressure drop across the filter element produced from the fibers. An exemplary dpf range for the filaments comprising the fiber inputs can be about 1 to about 15 (e.g., about 4 to about 12 or about 5 to about 10) where denier is expressed in units of grams/9000 meters, although larger and smaller filaments can be used without departing from the invention. The shapes of the individual filament cross-sections can also vary and can include, but are not limited to, multilobal (e.g., exhibiting a shape such as an "X," "Y," "H," "I," or "C" shape), rectangular, circular, or oblong.

The relative amounts of each fiber type utilized according to the methods of the invention can vary. For example, the fiber inputs can be in roughly equal proportions by weight, giving a final product comprising about 1:1 cellulose acetate fiber material: regenerated cellulose fiber material. In some embodiments, the inputs can be different, such that greater than 50% of the input comprises cellulose acetate material or such that greater than 50% of the input comprises regenerated cellulose material. The weight ratio of cellulose acetate fiber input to second fiber input can be from about 1:99 to about 99:1, and typically from about 25:75 to 75:25. For example, the mixed fiber bundle can be comprised of cellulose acetate fibers and regenerated cellulose fibers in ratios of 30:70, 40:60, 50:50, 60:40, 70:30, or in any other ratio determined to provide the desired characteristics of the combined fibers/yarns.

In certain embodiments, it can be desirable to maximize the degradable input (e.g., the regenerated cellulose) so as to maximize the degradability of the resulting product. However, maximizing the degradable input can, in certain embodiments, hinder the ability to plasticize the resulting blended fiber bundle (e.g., with triacetin). In such embodiments, therefore, a certain level of cellulose acetate is advantageously maintained to ensure sufficient plasticization, as well as the desirable taste and filtration properties of cellulose acetate.

In some instances, the fiber inputs used in the present invention to form the mixed fiber bundle can be at most partially drawn prior to blending. That is, since the mixed fiber bundle (e.g., the combined fiber bundle formed from the cellulose acetate fibers and the regenerated cellulose fibers) is drawn after the fibers are combined, it can be desirable for the fiber inputs not to be fully drawn prior to being combined. As such, if the cellulose acetate fibers or the regenerated cellulose fibers are drawn prior to being combined, it may be desirable for those fibers to be partially drawn, at most, so as to allow the fibers to further elongate upon drawing the mixed fiber bundle being in a subsequent process. In certain embodiments, the fiber inputs have at least about 50% elongation to break (e.g., at least about 60% or at least about 70%) remaining at the time of blending. Elongation to break (EB) and tenacity can be measured according to ASTM D-2256.

The cellulose acetate and regenerated cellulose fibers used as fiber inputs can be provided in different forms. In one aspect, the fibers can be provided in the form of respective yarns. For example, each yarn can be comprised of about 70 filaments, at about 4 dpf, so as to provide a yarn of about 300 total denier. The number of filaments, dpf, and total denier can vary without departing from the invention. In forming such yarns, the fibers therein can be arranged so as to be substantially parallel to each other along the axis of the yarn. As such, it may follow that, upon combining the cellulose acetate fiber yarns with the regenerated cellulose fiber yarns, the longitudinal axes of the yarns and/or the fibers thereof can be disposed substantially parallel to each other to form a mixed fiber bundle.

Figure 3:
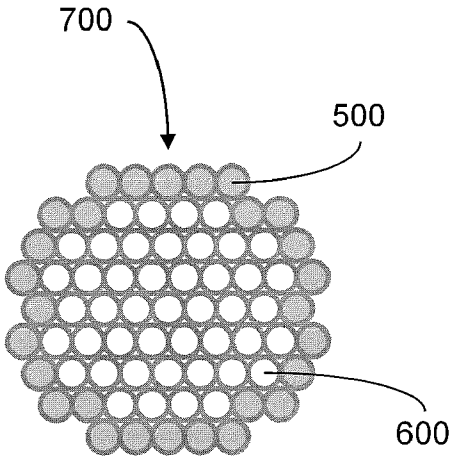
FIGS. 2 and 3 are illustrations of exemplary cross-sections of a mixed fiber bundle forming a biodegradable filter material for a filter element of a smoking article, according to certain aspects of the present disclosure.
Figure 2:
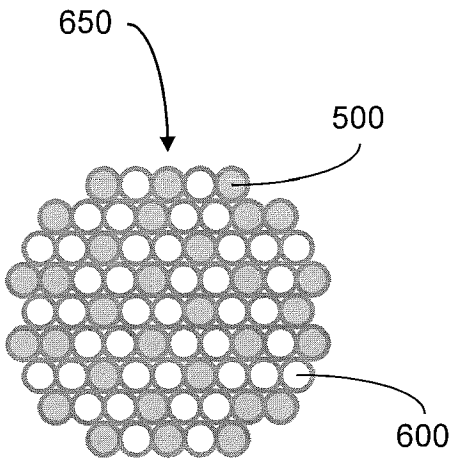

In some aspects, the cellulose acetate fibers and the regenerated cellulose fibers can be combined in different manners and/or in different proportions, as necessary or desired to accomplish the desired biodegradability of the resulting filter material. For example, as shown in FIG. 2, the cellulose acetate fibers 500 and regenerated cellulose fibers 600 can be combined such that the fibers and/or yarns are alternatingly disposed, or substantially uniformly interspersed with respect to each other, over a cross-section of the mixed fiber bundle. That is, in some instances, the cellulose acetate fibers/yarns 500 and the regenerated cellulose fibers/yarns 600 can each be arranged so as to be substantially uniformly distributed across the resulting mixed fiber bundle 650, for example, when viewed across the cross-section thereof. As previously discussed, the regenerated cellulose fibers/yarns can enhance the biodegradability of the resulting filter material, while the cellulose acetate fibers/yarns can enhance the plasticizability of the combined fibers with a suitable plasticizer such as, for example, triacetin, to maintain or enhance the flavor or other characteristics of the smoke expected by smokers/users. Accordingly, in some instances, the substantially uniform arrangement of the respective fibers/yarns can serve to enhance or balance these desired characteristics of the resulting filter material expected by smokers/users. One skilled in the art will appreciate, however, that in other instances, it can be desirable for the one type of the fibers/yarns to be disposed about an outer perimeter of the mixed fiber bundle, while the other type of the fibers/yarns to be disposed within the outer perimeter (see, e.g., FIG. 3). For example, the central core of the mixed fiber bundle 700 can comprise the regenerated cellulose fibers/yarns 600, wherein the central core is then surrounded by a perimeter of cellulose acetate fibers/yarns 500, or vice versa. In such configurations, the cellulose acetate fibers can be plasticized discretely from the regenerated cellulose fibers. In one instance, the desired taste of the smoke associated with the smoking article can be achieved by a configuration in which the central core of the mixed fiber bundle comprises the regenerated cellulose fibers/yarns, and wherein the central core is then surrounded by a perimeter of cellulose acetate fibers/yarns (see, e.g., FIG. 3).

As previously disclosed, once the cellulose acetate fibers/yarns and the regenerated cellulose fibers/yarns have been combined into a mixed fiber bundle, the mixed fiber bundle can then be drawn and crimped to form a mixed fiber tow. The drafting or drawing process generally results in reducing the weight/yard of a fiber bundle and increasing its length. In such instances, depending, for example, on the extent of the drawing process for the mixed fiber bundle, the component yarns can be provided in a slightly higher denier per filament so as to facilitate the achievement of the desired total denier and denier per filament of the mixed fiber tow following the drawing process. For instance, in one example, the individual yarns of the cellulose acetate and/or the regenerated cellulose fibers can be on the order of between about 6 denier per filament and about 8 denier per filament, in order to achieve between about 3 denier per filament and about 5 denier per filament in the drawn mixed fiber tow (e.g., with between about 20,000 total denier and about 80,000 total denier), after the drawing process. It may also be desirable for the mixed fiber bundle to be heated prior to and/or during the drawing process so as to facilitate drawing of the fibers therein.

A typical drawing process consists of multiple drawing stages using equipment known in the art. In one embodiment, the mixed fiber bundle is withdrawn from a creel and passed through several draw stands, each consisting of several rollers that apply tension to the fiber bundle. In between the draw stands, the fiber bundle can pass through a heated water bath, a steam chest, heated rolls, or combinations thereof. The number of draw stands can vary, but 2 to 4 draw stands are used in a typical drawing process.

Following drawing, the mixed fiber bundle is subjected to a crimping step. "Crimp" is texture or waviness of individual fibers or the mixed fiber bundle as a whole. Crimp frequency, which is reported in crimps per inch (cpi), is an indirect measure of the bulk of the material. In some embodiments, crimping can generally involves passing the fiber bundle through rollers and into a "stuffing box" or "stuffer box," wherein friction generates pressure, causing the fibers to buckle. Various crimp levels can be provided. For example, in some embodiments, the crimp level can be from about 10 to about 30 crimps per inch, e.g., about 15 to about 26 crimps per inch. Crimp can also be expressed in terms of crimp ratio, with an exemplary crimp ratio range of about 1.2 to about 1.8. The crimp frequency can be measured according to ASTM D3937-94.

Once the mixed fiber tow is drawn and crimped, the drawn and crimped mixed fiber tow can be processed into a filter element of a smoking article in a similar manner to conventional cellulose acetate tow. For example, the mixed fiber tow can be bloomed to form the filter element of the smoking article, wherein the blooming process can also involve or otherwise be associated with a plasticizing process in which a suitable plasticizer, such as triacetin, carbowax and/or triethyl citrate, is applied to the bloomed mixed fiber tow.

In another aspect of the disclosure, a biodegradable filter material for a filter element of a smoking article can be provided, wherein such a filter material comprises a mixed fiber tow including drawn and crimped combined fibers, and wherein the combined fibers including cellulose acetate fibers and regenerated cellulose fibers. Such a filter material can be formed according to the disclosed methods so as to have the advantageous characteristics as otherwise disclosed herein.

Figure 4:
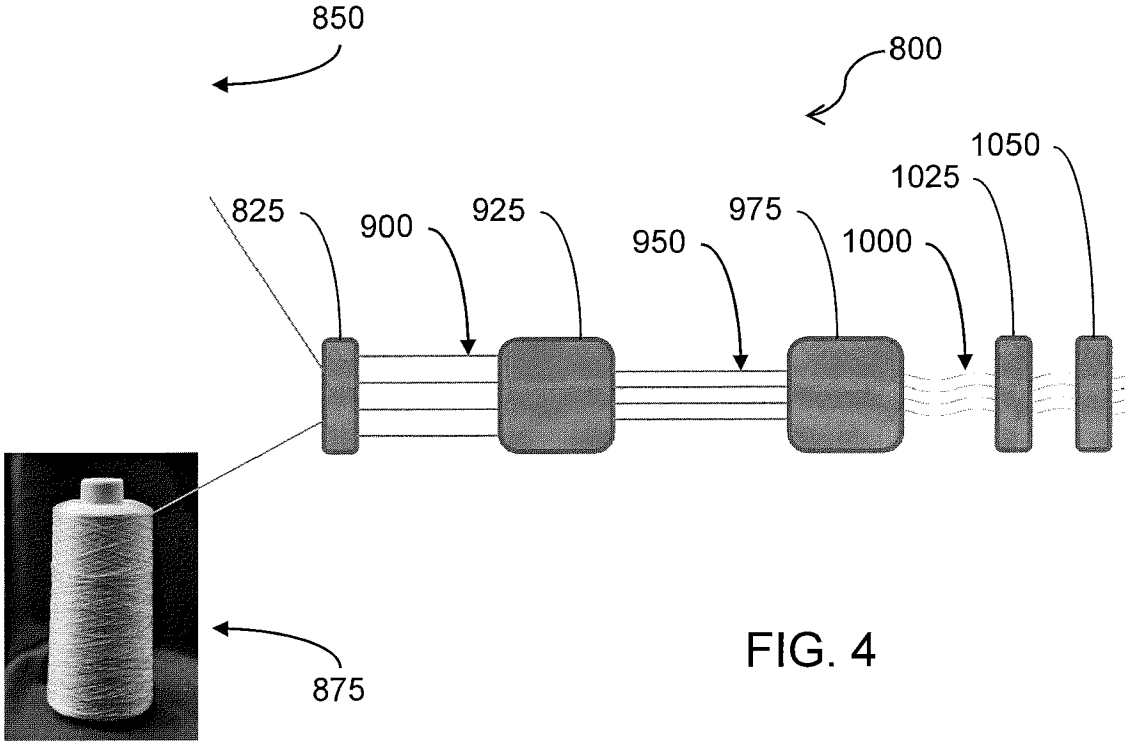
FIG. 4 is a schematic illustration of a system for forming a biodegradable filter material for a filter element of a smoking article, according to one aspect of the present disclosure.

Another aspect of the present disclosure is directed to a system for forming a biodegradable filter material for a filter element of a smoking article, indicated generally by element 800 in FIG. 4. In some instances, such a system can comprise a combining unit 825 configured to combine cellulose acetate fibers with regenerated cellulose fibers, such as rayon fibers. For example, bobbins of the cellulose acetate fibers/yarns 850 and the regenerated cellulose fibers/yarns 875 can be engaged with a creel (not shown), wherein the fibers/yarns can then be directed to the combining unit 825 to be combined into a mixed fiber bundle 900 having a desired total denier. The combining unit 825 can also be configured to process the fibers/yarns such that the cellulose acetate fibers and regenerated cellulose fibers are one of alternatingly disposed and substantially uniformly interspersed with respect to each other, over a cross-section of the mixed fiber bundle (see, e.g., FIG. 2). In other instances, the combining unit can be configured to combine the cellulose acetate fibers with regenerated cellulose fibers such that one of the cellulose acetate fibers and regenerated cellulose fibers is arranged to form a central core and the other of the cellulose acetate fibers and regenerated cellulose fibers is arranged perimetrically about the central core, with respect to a cross-section of the mixed fiber bundle (see, e.g., FIG. 3). In any instance, the combining unit 825 can be configured to combine the cellulose acetate fibers/yarns with the regenerated cellulose fibers/yarns, such that longitudinal axes thereof are disposed substantially parallel to each other in forming the mixed fiber bundle.

The system can further comprise a drawing unit 925 configured to receive the mixed fiber bundle 900 from the combining unit 825 and to draw the combined cellulose acetate fibers and regenerated cellulose fibers to form drawn combined fibers 950. As disclosed, the drawing unit 925 can be configured to draw the combined cellulose acetate fibers and regenerated cellulose fibers to form a drawn mixed fiber bundle of between about 20,000 total denier and about 80,000 total denier. A crimping unit 975 can be configured to receive and crimp the drawn combined fibers to form a mixed fiber tow 1000. In some instances, the drawing unit 925 and/or the crimping unit 975 can be configured to apply heat (i.e., by way of an appropriate heating arrangement or device such as a water bath or steam chest or heated rolls) to the fibers/yarns being drawn and/or crimped, as will be appreciated by one skilled in the art. At this point in the process, the drawn and crimped fibers can be dried and formed into a tow for later use in a cigarette filter-making process. Alternatively, as shown in FIG. 4, the mixed fiber tow can pass directly into filter-making processing equipment, such as a blooming device 1025. The bloomed tow can then be plasticized via application of a plasticizer, such as triacetin, thereto by an appropriate plasticizer application device 1050. If desired, the mixed fiber tow can also pass through a finish applicator (not shown) if a finish is to be applied to the fiber.

The mixed fiber tow can be wrapped with a plug wrap such that each end of the filter material remains exposed. The plug wrap can vary. See, for example, U.S. Pat. No. 4,174,719 to Martin, which is incorporated herein by reference. Typically, the plug wrap is a porous or non-porous paper material. Suitable plug wrap materials are commercially available. Exemplary plug wrap papers ranging in porosity from about 1100 CORESTA units to about 26000 CORESTA units are available from Schweitzer-Maudit International as Porowrap 17-M1, 33-M1, 45-M1, 70-M9, 95-M9, 150-M4, 150-M9, 240M9S, 260-M4 and 260-M4T; and from Miquel-y-Costas as 22HP90 and 22HP150. Non-porous plug wrap materials typically exhibit porosities of less than about 40 CORESTA units, and often less than about 20 CORESTA units. Exemplary non-porous plug wrap papers are available from Olsany Facility (OP Paprina) of the Czech Republic as PW646; Wattenspapier of Austria as FY/33060; Miquel-y-Costas of Spain as 646; and Schweitzer-Mauduit International as MR650 and 180. Plug wrap paper can be coated, particularly on the surface that faces the mixed fiber tow, with a layer of a film-forming material. Such a coating can be provided using a suitable polymeric film-forming agent (e.g., ethylcellulose, ethylcellulose mixed with calcium carbonate, nitrocellulose, nitrocellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

If desired, so-called "non-wrapped acetate" filter segments can also be produced. Such segments are produced using the types of techniques generally set forth herein. However, rather than employing a plug wrap that circumscribes the longitudinally extending periphery of the filter material, a somewhat rigid rod is provided, for example, by applying steam to the shaped mixed fiber tow. Techniques for commercially manufacturing non-wrapped acetate filter rods are possessed by Filtrona Corporation, Richmond, Va.

Filter material, such as the mixed fiber tow disclosed herein, can be processed using a conventional filter tow processing unit. For example, filter tow can be bloomed using bussel jet methodologies or threaded roll methodologies. An exemplary tow processing unit has been commercially available as E-60 supplied by Arjay Equipment Corp., Winston-Salem, N.C. Other exemplary tow processing units have been commercially available as AF-2, AF-3 and AF-4 from Hauni-Werke Korber & Co. KG. and as Candor-ITM Tow Processor from International Tobacco Machinery. Other types of commercially available tow processing equipment, as are known to those of ordinary skill in the art, can be employed.

In some aspects, other types of filter materials, such as gathered paper, nonwoven polypropylene web or gathered strands of shredded web, can be provided in addition to the components of the mixed fiber tow disclosed herein, and can be processed, for example, using the types of materials, equipment and techniques set forth in U.S. Pat. No. 4,807,809 to Pryor et al. and U.S. Pat. No. 5,025,814 to Raker. In addition, representative manners and methods for operating a filter material supply units and filter-making units are set forth in U.S. Pat. No. 4,281,671 to Bynre; U.S. Pat. No. 4,850,301 to Green, Jr. et al.; U.S. Pat. No. 4,862,905 to Green, Jr. et al.; U.S. Pat. No. 5,060,664 to Siems et al.; U.S. Pat. No. 5,387,285 to Rivers and U.S. Pat. No. 7,074,170 to Lanier, Jr. et al.

Filter elements for smoking articles, such a filtered cigarettes, can be provided from filter rods manufactured from the mixed fiber tow using traditional types of cigarette making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 6,229,115 to Vos et al.; U.S. Pat. No. 7,434,585 to Holmes; and U.S. Pat. No. 7,296,578 to Read, Jr.; each of which is incorporated herein by reference. The operation of those types of devices will be readily apparent to those skilled in the art of automated cigarette manufacture.

Cigarette filter rods can be used to provide multi-segment filter rods. Such multi-segment filter rods can be employed for the production of filtered cigarettes possessing multi-segment filter elements. An example of a two-segment filter element is a filter element possessing a first cylindrical segment incorporating activated charcoal particles (e.g., a "dalmation" type of filter segment) at one end, and a second cylindrical segment that is produced from a filter rod, with or without objects inserted therein. The production of multi-segment filter rods can be carried out using the types of rod-forming units that have been employed to provide multi-segment cigarette filter components. Multi-segment cigarette filter rods can be manufactured, for example, using a cigarette filter rod making device available under the brand name Mulfi from Hauni-Werke Korber & Co. KG of Hamburg, Germany. Filter rods can be manufactured using a rod-making apparatus, and an exemplary rod-making apparatus includes a rod-forming unit. Representative rod-forming units are available as KDF-2, KDF-2E, KDF-3, and KDF-3E from Hauni-Werke Korber & Co. KG; and as Polaris-ITM Filter Maker from International Tobacco Machinery.

Filter elements formed according to the invention typically exhibit a hardness that is comparable to filter elements made from conventional cellulose acetate tow. The amount of plasticizer added to the filter rod and the denier per filament of the filter tow can significantly affect hardness of the filter. Filter hardness is a measurement of the compressibility of the filter material. A test instrument that can be used for harness testing is a D61 Automatic Hardness Tester available from Sodim SAS. This instrument applies a constant load (e.g., 300 g) to the sample for a fixed period of time (e.g., 3 to 5 seconds) and digitally displays the compression value as a percentage difference in the average diameter of the filter element. In certain embodiments, the filter element of the invention exhibit a hardness of at least about 90%, more often at least about 92%, and most often at least about 94% (e.g., about 90% to about 99%, more typically about 94 to about 98%). Testing procedures for cigarette filter hardness are described, for example, in Example 5 below and in U.S. Pat. No. 3,955,406 to Strydom and U.S. Pat. No. 4,232,130 to Baxter et al., both of which are incorporated by reference herein.

Filter elements produced in accordance with this disclosure can be incorporated within conventional cigarettes configured for combustion of a smokable material, and also within the types of cigarettes set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, I I I et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 to Beven; which are incorporated herein by reference. Still further, filter elements produced in accordance with the description provided above can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference. Other examples of non-traditional cigarettes, commonly referred to as "e-cigarettes", which could incorporate a filter element of the present invention, include U.S. Pat. No. 7,726,320 to Robinson et al. and U.S. Pat. No. 8,079,371 to Robinson et al., and U.S. patent application Ser. No. 13/205,841 to Worm et al., filed on Aug. 9, 2011; Ser. No. 13/432,406 to Griffith Jr. et al., filed on Mar. 28, 2012; and Ser. No. 13/536,438 to Sebastian et al, filed on Jun. 28, 2012, all of which are incorporated by reference herein.

The smokable material employed in manufacture of the smokable rod can vary. For example, the smokable material can have the form of filler (e.g., such as tobacco cut filler). As used herein, the terms "filler" or "cut filler" are meant to include tobacco materials and other smokable materials which have a form suitable for use in the manufacture of smokable rods. As such, filler can include smokable materials which are blended and are in a form ready for cigarette manufacturer. The filler materials normally are employed in the form of strands or shreds as is common in conventional cigarette manufacture. For example, the cut filler material can be employed in the form of strands or shreds from sheet-like or "strip" materials which are cut into widths ranging from about 1/20 inch to about 1/60 inch, preferably from about 1/25 inch to about 1/35 inch. Generally, such strands or shreds have lengths which range from about 0.25 inch to about 3 inches.

Examples of suitable types of tobacco materials include flue-cured, Burley, Md. or Oriental tobaccos, rare or specialty tobaccos, and blends thereof. The tobacco material can be provided in the form of tobacco lamina; processed tobacco, processed tobacco stems such as cut-rolled or cut-puffed stems, reconstituted tobacco materials; or blends thereof. The smokable material or blend of smokable materials can consist essentially of tobacco filler material. Smokable materials can also be cased and top dressed as is conventionally performed during various stages of cigarette manufacture.

Typically, the smokable rod has a length which ranges from about 35 mm to about 85 mm, preferably about 40 to about 70 mm; and a circumference of about 17 mm to about 27 mm, preferably about 22.5 mm to about 25 mm. Short cigarette rods (i.e., having lengths from about 35 to about 50 mm) can be employed, particularly when smokable blends having a relatively high packing density are employed.

The wrapping material can vary, and typically is a cigarette wrapping material having a low air permeability value. For example, such wrapping materials can have air permeabilities of less than about 5 CORESTA units. Such wrapping materials include a cellulosic base web (e.g., provided from wood pulp and/or flax fibers) and inorganic filler material (e.g., calcium carbonate and/or magnesium hydroxide particles). A suitable wrapping material is a cigarette paper consisting essentially of calcium carbonate and flax. Particularly preferred wrapping materials include an amount of a polymeric film forming agent sufficient to provide a desirably low air permeability. Exemplary wrapping materials 164 are P-2540-80, P-2540-81, P-2540-82, P-2540-83, P-2540-84, and P-2831-102 available from Kimberly-Clark Corporation and TOD 03816, TOD 05504, TOD 05560 and TOD 05551 available from Ecusta Corporation.

The packing densities of the blend of smokable materials contained within the wrapping materials can vary. Typical packing densities for smokable rods can range from about 150 to about 300 mg/cm$^3$. Normally, packing densities of the smokable rods range from about 200 to about 280 mg/cm$^3$.

The cigarette making operations will include attaching the mixed fiber tow-based filter element to the smokable rod. For example, the filter element and a portion of the smokable rod can be circumscribed by a tipping material with an adhesive configured to bind to the filter element and the tobacco rod so as to couple the mixed fiber tow-based filter element to an end of the tobacco rod.

Typically, the tipping material circumscribes the filter element and an adjacent region of the smokable rod such that the tipping material extends about 3 mm to about 6 mm along the length of the smokable rod. Typically, the tipping material is a conventional paper tipping material. The tipping material can have a permeability which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

Accordingly, cigarettes (or other smokable articles) can be produced in accordance with the above-described example embodiments, or under various other embodiments of systems and methods for producing cigarettes. The cigarette making operations performed after production of the mixed fiber tow as described above may, in certain embodiments, be substantially the same as those performed in traditional systems for producing smoking articles. Thus, existing cigarette production equipment can be utilized. It is noted that the system for forming cigarettes can also include other apparatuses and components that correspond with the operations discussed above.

Figure 5:
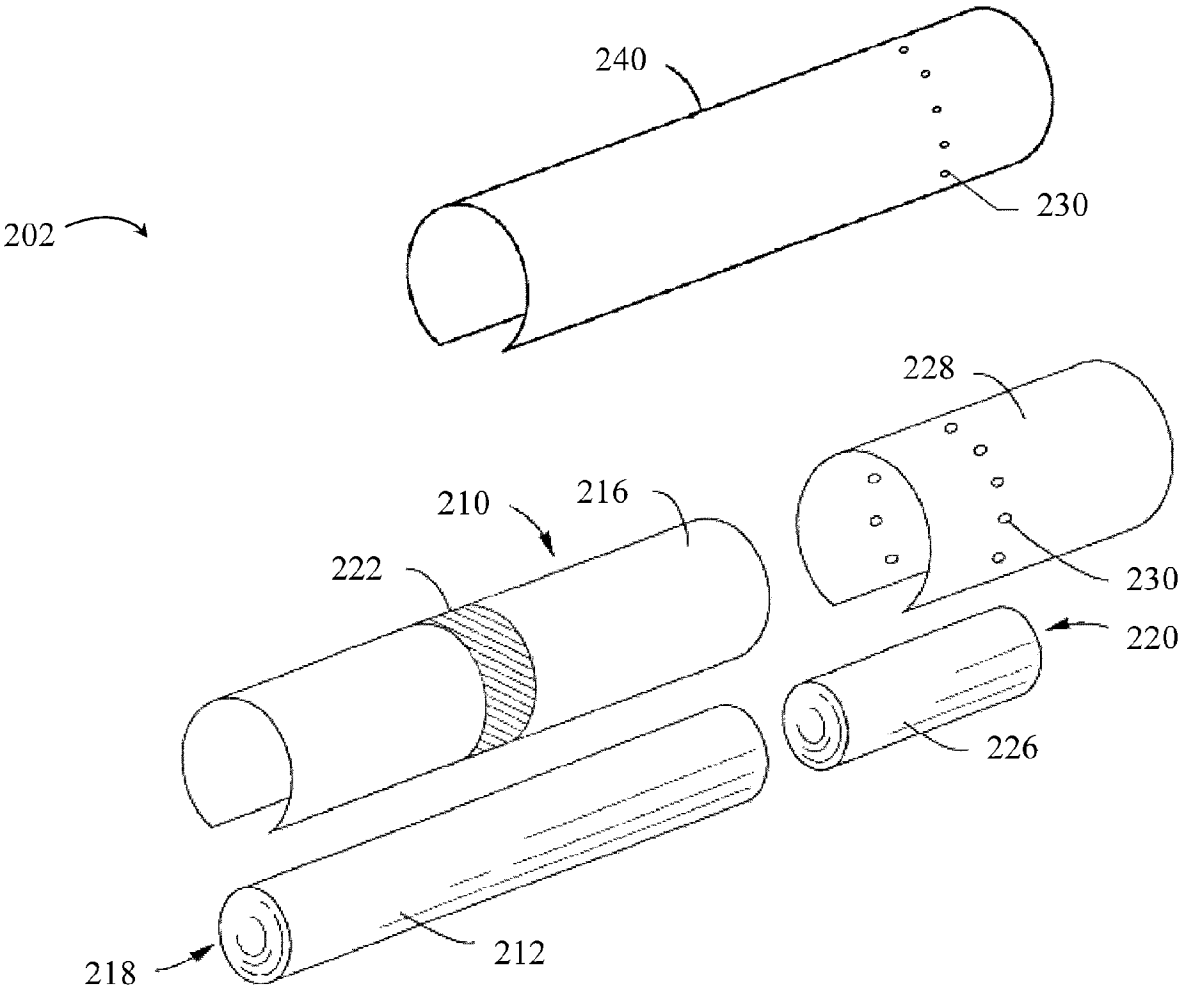
FIG. 5 is an exploded view of an example embodiment of a cigarette produced in accordance with the systems, methods, and apparatuses disclosed herein.

FIG. 5 illustrates an exploded view of a smoking article in the form of a cigarette 202 that can be produced by the apparatuses, systems, and methods disclosed herein. The cigarette 202 includes a generally cylindrical rod 212 of a charge or roll of smokable filler material contained in a circumscribing wrapping material 216. The rod 212 is conventionally referred to as a "tobacco rod." The ends of the tobacco rod 212 are open to expose the smokable filler material. The cigarette 202 is shown as having one optional band 222 (e.g., a printed coating including a film-forming agent, such as starch, ethylcellulose, or sodium alginate) applied to the wrapping material 216, and that band circumscribes the cigarette rod 212 in a direction transverse to the longitudinal axis of the cigarette 202. That is, the band 222 provides a cross-directional region relative to the longitudinal axis of the cigarette 202. The band 222 can be printed on the inner surface of the wrapping material 216 (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 212 is the lighting end 218, and at the mouth end 220 is positioned a mixed fiber tow 226. The mixed fiber tow 226 can be produced by the apparatuses, systems, and methods disclosed herein. The mixed tow-based filter element 226 can have a generally cylindrical shape, and the diameter thereof can be essentially equal to the diameter of the tobacco rod 212. The mixed tow-based filter 226 is circumscribed along its outer circumference or longitudinal periphery by a layer of outer plug wrap 228 to form a filter element. The filter element is positioned adjacent one end of the tobacco rod 212 such that the filter element and tobacco rod are axially aligned in an end-to-end relationship, preferably abutting one another. The ends of the filter element permit the passage of air and smoke therethrough.

A ventilated or air diluted smoking article can be provided with an optional air dilution means, such as a series of perforations 230, each of which extend through the tipping material 240 and plug wrap 228. The optional perforations 230 can be made by various techniques known to those of ordinary skill in the art, such as laser perforation techniques. Alternatively, so-called off-line air dilution techniques can be used (e.g., through the use of porous paper plug wrap and pre-perforated tipping material). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette. The mixed tow-based filter element 226 can be attached to the tobacco rod 212 using the tipping material 240 (e.g., essentially air impermeable tipping material), that circumscribes both the entire length of the filter element and an adjacent region of the tobacco rod 212. The inner surface of the tipping material 240 is fixedly secured to the outer surface of the plug wrap 228 and the outer surface of the wrapping material 216 of the tobacco rod, using a suitable adhesive; and hence, the filter element and the tobacco rod are connected to one another to form the cigarette 202.

Certain cigarettes or other smoking articles made according to the method of the present invention exhibit desirable resistance to draw. For example, an exemplary cigarette exhibits a pressure drop of between about 50 mm and about 200 mm water pressure drop at 17.5 cc/sec. air flow. In certain embodiments, cigarettes of the invention exhibit pressure drop values of between about 70 mm and about 180 mm, more preferably between about 80 min to about 150 mm water pressure drop at 17.5 cc/sec. air flow. Typically, pressure drop values of cigarettes are measured using a Filtrona Quality Test Modules (QTM Series) available from Filtrona Instruments and Automation Ltd.

Although the present disclosure focuses on biodegradable filter element embodiments comprising cellulose acetate fibers and regenerated cellulose fibers, the invention is also applicable to other combinations of dissimilar fiber types using the methods, systems, and apparatuses described herein. In some embodiments, the two or more dissimilar fibers can be characterized as having different filtration properties or exhibiting different levels of biodegradability. By combining such fibers in the same filter element using the apparatuses, systems, and methods of the present disclosure, the overall level of biodegradability of the filter element can be adjusted to a desired level or the filtration efficiency with respect to specific solid or gaseous components of mainstream smoke can be adjusted as desired. Examples of combinations of fiber types exhibiting different filtration characteristics can be found, for example, in US Pat. Appl. Pub. No. 2012/0024304 to Sebastian et al., which is incorporated by reference herein in its entirety. In some embodiments, by combining different fiber types in the same filter element using the apparatuses, systems, and methods of the present disclosure, the filter element incorporated within a cigarette can achieve the desired function (e.g., desired level of biodegradability and/or filtration efficiency) while providing the user with acceptable taste characteristics typically associated with traditional cellulose acetate-based filter elements. Any of the fiber types disclosed herein could be used as a substitute for the regenerated fiber input taught herein, and can exhibit the same filament/yarn characteristics (e.g., dpf, total denier, filament cross-section, etc.) taught herein without departing from the invention.

For example, in certain embodiments, the second fiber input other than cellulose acetate is any degradable (e.g., biodegradable) fiber. The term "biodegradable" as used in reference to a degradable polymer refers to a polymer that degrades under aerobic and/or anaerobic conditions in the presence of bacteria, fungi, algae, and/or other microorganisms into carbon dioxide/methane, water and biomass, although materials containing heteroatoms can also yield other products such as ammonia or sulfur dioxide. "Biomass" generally refers to the portion of the metabolized materials incorporated into the cellular structure of the organisms present or converted to humus fractions indistinguishable from material of biological origin.

Biodegradability can be measured, for example, by placing a sample in environmental conditions expected to lead to decomposition, such as placing a sample in water, a microbe-containing solution, a compost material, or soil. The degree of degradation can be characterized by weight loss of the sample over a given period of exposure to the environmental conditions. Exemplary rates of degradation for certain filter element embodiments of the invention include a weight loss of at least about 20% after burial in soil for 60 days or a weight loss of at least about 30% after 15 days of exposure to a typical municipal composter. However, rates of biodegradation can vary widely depending on the type of degradable particles used, the remaining composition of the filter element, and the environmental conditions associated with the degradation test. U.S. Pat. No. 5,970,988 to Buchanan et al. and U.S. Pat. No. 6,571,802 to Yamashita provide exemplary test conditions for degradation testing. The degradability of a plastic material also can be determined using one or more of the following ASTM test methods: D5338, D5526, D5988, D6400, and D7081. Other degradability testing methods include ISO Method 9408 and Biochemical Methane Potential (BMP) testing.

In certain embodiments, the mixed fiber tow of the invention can be used to produce smoking article filters (e.g., cigarette filters) wherein the filter element exhibits a degradation rate that is faster than that of a conventional cellulose acetate filter element (i.e., 100% cellulose acetate filter tow). Exemplary degradation rates for certain embodiments of the present invention include at least about 50% faster than conventional CA filter elements or at least about 60% or at least about 70% faster. The rate of degradation can be determined using various means, such as percentage of carbon conversion (oxidation) or oxygen uptake.

Exemplary biodegradable materials that can be used in a fibrous form in the present invention include aliphatic polyesters, cellulose, regenerated cellulose, cellulose acetate fibers with imbedded starch particles, polyvinyl alcohol, starch, aliphatic polyurethanes, polyesteramides, cis-polyisoprene, cis-polybutadiene, polyanhydrides, polybutylene succinate, proteins, alginate, and copolymers and blends thereof. Additional examples of biodegradable materials include thermoplastic cellulose, available from Toray Industries, Inc. of Japan and described in U.S. Pat. No. 6,984,631 to Aranishi et al., which is incorporated by reference herein, and thermoplastic polyesters such as Ecoflex® aliphatic-aromatic copolyester materials available from BASF Corporation or poly(ester urethane) polymers described in U.S. Pat. No. 6,087,465 to Seppälä et al., which is incorporated by reference herein in its entirety. Any of these biodegradable fibers can further include a cellulose acetate coating on the outer surface thereof.

Exemplary aliphatic polyesters advantageously used in the present invention have the structure $—[C(O)—R—O]_n—$, wherein n is an integer representing the number of monomer units in the polymer chain and R is an aliphatic hydrocarbon, preferably a C1-C10 alkylene, more preferably a C1-C6 alkylene (e.g., methylene, ethylene, propylene, isopropylene, butylene, isobutylene, and the like), wherein the alkylene group can be a straight chain or branched. Exemplary aliphatic polyesters include polyglycolic acid (PGA), polylactic acid (PLA) (e.g., poly(L-lactic acid) or poly(DL-lactic acid)), polyhydroxyalkanoates (PHAs) such as polyhydroxypropionate, polyhydroxyvalerate, polyhydroxybutyrate, polyhydroxyhexanoate, and polyhydroxyoctanoate, polycaprolactone (PCL), polybutylene succinate, polybutylene succinate adipate, and copolymers thereof (e.g., polyhydroxybutyrate-co-hydroxyvalerate (PHBV)).

Various other degradable materials suitable for use in the present invention are set forth, for example, in US Pat. Appl. Pub. Nos. 2009/0288669 to Hutchens, 2011/0036366 to Sebastian; 2012/0000479 to Sebastian et al, 2012/0024304 to Sebastian, and U.S. patent application Ser. No. 13/194,063 to Sebastian et al., filed Jul. 29, 2011, all of which are incorporated by reference herein.

In some embodiments, one of the fiber inputs comprises standard cellulose acetate fibers and one of the fiber inputs comprises carbon fibers, ion exchange fibers, and/or catalytic fibers. Carbon fibers can be described as fibers obtained by the controlled pyrolysis of a precursor fiber. Sources of carbon fibers include Toray Industries, Toho Tenax, Mitsubishi, Sumitomo Corporation, Hexcel Corp., Cytec Industries, Zoltek Companies, and SGL Group. Exemplary commercially available carbon fibers include ACF-1603-15 and ACF- 1603-20 available from American Kynol, Inc. Examples of starting materials, methods of preparing carbon-containing fibers, and types of carbon-containing fibers are disclosed in U.S. Pat. No. 3,319,629 to Chamberlain; U.S. Pat. No. 3,413,982 to Sublett et al.; U.S. Pat. No. 3,904,577 to Buisson; U.S. Pat. No. 4,281,671 to Bynre et al.; U.S. Pat. No. 4,876,078 to Arakawa et al.; U.S. Pat. No. 4,947,874 to Brooks et al.; U.S. Pat. No. 5,230,960 to Iizuka; U.S. Pat. No. 5,268,158 to Paul, Jr.; U.S. Pat. No. 5,338,605 to Noland et al.; U.S. Pat. No. 5,446,005 to Endo; U.S. Pat. No. 5,482,773 to Bair; U.S. Pat. No. 5,536,486 to Nagata et al.; U.S. Pat. No. 5,622,190 to Arterbery et al.; and U.S. Pat. No. 7,223,376 to Panter et al.; and U.S. Pat. Publication Nos. 2003/0200973 to Xue et al.; 2006/0201524 to Zhang et al. 2006/0231113 to Newbery et al., and 2009/0288672 to Hutchens, all of which are incorporated herein by reference.

Ion exchange fibers are fibers capable of ion exchange with gas phase components of mainstream smoke from a smoking article. Such fibers are typically constructed by imbedding particles of an ion exchange material into the fiber structure or coating the fiber with an ion exchange resin. The amount of ion exchange material present in the fiber can vary, but is typically about 10 to about 50 percent by weight, based on the total weight of the ion exchange fiber, more often about 20 to about 40 percent by weight. Exemplary ion exchange fibers are described in U.S. Pat. No. 3,944,485 to Rembaum et al. and U.S. Pat. No. 6,706,361 to Economy et al, both of which are incorporated by reference herein. Ion exchange fibers are commercially available, for example, from Fiban of Belarus and Kelheim Fibers GmbH of Germany. Exemplary products from Fiban include FIBAN A-1 (monofunctional strong base fiber with $—N^+(CH_3)_3Cl^-$ functional group), FIBAN AK-22-1 (polyfunctional fiber with EN, =NH, and —COOH functional groups), FIBAN K-1 (monofunctional strong acid fiber with $—SO^{3-}H^+$ functional group), FIBAN K-3 (polyfunctional fiber with —COOH, $—NH_2$, and =NH functional groups), FIBAN K-4 (monofunctional weak acid fiber with —COOH functional group), FIBAN X-1 (iminodiacetic fiber) FIBAN K-1-1 (strong acid fiber similar to FIBAN K-1 modified by potassium-cobalt-ferrocyanide), FIBAN A-5 (polyfunctional fiber with $—N(CH_3)_2$, =NH, and —COOH functional groups), FIBAN A-6 and A-7 (polyfunctional fiber with strong and weak base amine groups), FIBAN AK-22B (polyfunctional fiber similar to FIBAN K-3), and FIBAN S (monofunctional fiber with $[FeOH]^{2+}$ functional group). One exemplary product from Kelheim Fibers is the Poseidon Fiber.

Catalytic fibers are fibers capable of catalyzing the reaction of one or more gas phase components of mainstream smoke, thereby reducing or eliminating the presence of the gas phase component in the smoke drawn through the filter element. Exemplary catalytic fibers catalyze oxidation of one or more gaseous species present in mainstream smoke, such as carbon monoxide, nitrogen oxides, hydrogen cyanide, catechol, hydroquinone, or certain phenols. The oxidation catalyst used in the invention is typically a catalytic metal compound (e.g., metal oxides such as iron oxides, copper oxide, zinc oxide, and cerium oxide) that oxidizes one or more gaseous species of mainstream smoke. Exemplary catalytic metal compounds are described in U.S. Pat. No. 4,182,348 to Seehofer et al.; U.S. Pat. No. 4,317,460 to Dale et al.; U.S. Pat. No. 4,956,330 to Elliott et al.; U.S. Pat. No. 5,050,621 to Creighton et al.; U.S. Pat. No. 5,258,340 to Augustine et al.; U.S. Pat. No. 6,503,475 to McCormick; U.S. Pat. No. 6,503,475 to McCormick, U.S. Pat. No. 7,011,096 to Li et al.; U.S. Pat. No. 7,152,609 to Li et al.; U.S. Pat. No. 7,165,553 to Luan et al.; U.S. Pat. No. 7,228,862 to Hajaligol et al.; U.S. Pat. No. 7,509,961 to Saoud et al.; U.S. Pat. No. 7,549,427 to Dellinger et al.; U.S. Pat. No. 7,560,410 to Pillai et al.; and U.S. Pat. No. 7,566,681 to Bock et al.; and US Pat. Publication Nos. 2002/0167118 to Billiet et al.; 2002/0172826 to Yadav et al.; 2002/0194958 to Lee et al.; 2002/014453 to Lilly Jr., et al.; 2003/0000538 to Bereman et al.; 2005/0274390 to Banerjee et al.; 2007/0215168 to Banerjee et al.; 2007/0251658 to Gedevanishvili et al.; 2010/0065075 to Banerjee et al.; 2010/0125039 to Banerjee et al.; and 2010/0122708 to Sears et al., all of which are incorporated by reference herein in their entirety. Catalytic fibers can be constructed by, for example, imbedding particles of a catalytic material into the fiber structure or coating the fiber with a catalytic material, such as metal oxide particles. The amount of catalytic material present in the fiber can vary, but is typically about 10 to about 50 percent by weight, based on the total weight of the ion exchange fiber, more often about 20 to about 40 percent by weight. International Application No. WO 1993/005868, also incorporated herein by reference, describes the use of catalytic fibers formed by coating a surface-treated hopcalite material, which is a material including both copper oxides and manganese oxides available from the North Carolina Center for Research located in Morrisville, N.C., onto a fibrous support.

By way of example, cotton and/or regenerated cellulose having ion exchange groups introduced thereto can be employed, for example, as an ion-exchange fiber configured for vapor absorption. By way of further example, polylactic acid and/or polyhydroxyalkanoate can be employed as one or more fibers for improved biodegradability. Activated carbon fibers can also be employed for improved particle filtration and/or improved vapor absorption. The fibers can include any other fibers, which can be selected for improved biodegradability, improved particulate filtration, improved vapor absorption, and/or any other beneficial aspect associated with the fibers. For further examples, see the material compositions set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al.; and U.S. Pat. No. 5,271,419 to Arzonico et al.; each of which is incorporated herein by reference. Thereby, for example, the aspects of cellulose acetate that may be desirable (e.g., taste and filtration) may be retained while offering other functionality (e.g., improved biodegradability, improved particulate filtration, and/or improved vapor absorption).

EXPERIMENTAL

Example 1

Mixed Fiber Tow Preparation

The following yarns are used to prepare a mixed fiber tow: (1) Chromspun® cellulose acetate fibers (black in color); (2) Estron® cellulose acetate fibers (white in color); and (3) Carotex rayon natural fibers. The Chromspun® cellulose acetate fibers (available from Eastman Chemical Company) have a tenacity of 1.38 g/denier and a maximum elongation of 32%. The Estron® cellulose acetate fibers (available from Eastman Chemical Company) are characterized as 300 denier, 76 filaments, and have a 3.94 dpf. The tenacity of the Estron® cellulose acetate fibers is 1.50 g/denier and the maximum elongation is 30%. The Carotex rayon fibers (available from KCTex, Hickory, N.C.) are characterized as 300 denier, 76 filaments, and have a 3.94 dpf. The tenacity of the rayon fibers is 1.89 g/denier with a maximum elongation of 32%.

The black and white cellulose acetate fibers are used in order to visually assess the uniformity of the fiber blending.

The fiber inputs are processed on a fiber production system that included the following in sequence: (1) a first draw stand; (2) a water bath; (3) a second draw stand; (4) a steam chest; (5) a third draw stand; (6) a finish applicator; (7) a crimper with steam addition; (8) a drying oven with conveyor belt; (9) a tension stand; and (10) a tow bailer. Blends are prepared having three cellulose acetate/rayon ratios (based on total number of filaments within blend): 70/30 cellulose acetate/rayon; 50/50 cellulose acetate/rayon; and 30/70 cellulose acetate/rayon.

The two yarn types (cellulose acetate and rayon) are arranged on a creel so that maximum mixing is achieved. The final total denier exiting the creel is approximately 40,000. Hence, the 70/30 ratio run has 94 acetate yarns and 40 rayon yarns, making a total denier of 40,200. The 50/50 blend run has 68 acetate yarns and 66 rayon yarns, making a total denier of 40,200. The 30/70 blend run has 48 acetate yarns and 82 rayon yarns making a total denier of 39,000. The collected yarn bundles are run at a speed of 58 meters/minute without draw and then pass through a finish applicator bath that applies approximately 2.5% finish by weight of the fiber. The fiber bundle is then passed through a crimp roller while maintaining a pressure of 40 psi. The cheek plate pressure is 50 psi and the flapper pressure is 10 psi. The crimps per inch of the fiber bundle entering dryer is about 20-25. The dryer temperature is 40° C.

All there tow fiber blends have relatively low breaking strength compared to conventional cellulose acetate tow when subjectively assessed. During a very short period, the above runs are altered by applying a 1.2× draw on the yarn bundle with hot water bath maintained at 55-60° C., which improves the resulting tow bundle strength significantly. Mixing in each tow blend is judged to be good based on visual inspection of the placement of the white and black cellulose acetate fibers within the tow bundle.

Example 2

Degradation Testing in Marine Environment

Several mixed fiber tows were tested for biodegradation in a marine environment per ASTM D7081 specification standard with ASTM D-6691 test method. The following samples are evaluated: (1) samples of three mixed fiber tows made using a fiber bundle from each run of Example 1; (2) samples of tow fibers prepared from 100% rayon and 100% cellulose acetate available from Lenzing and Eastman Chemical Company, respectively; and (3) a positive control of cellulose paper and a negative control of polyethylene (LDPE) plastic wrap. All samples are placed in a controlled warm and humid environment of 30° C. for 60 days in marine water. The biodegradation is evaluated by measuring $CO_2$ gas, which evolves from the degrading compostable samples while in 5-liter jars. The samples are tested in triplicate for each material.

Figure 6:
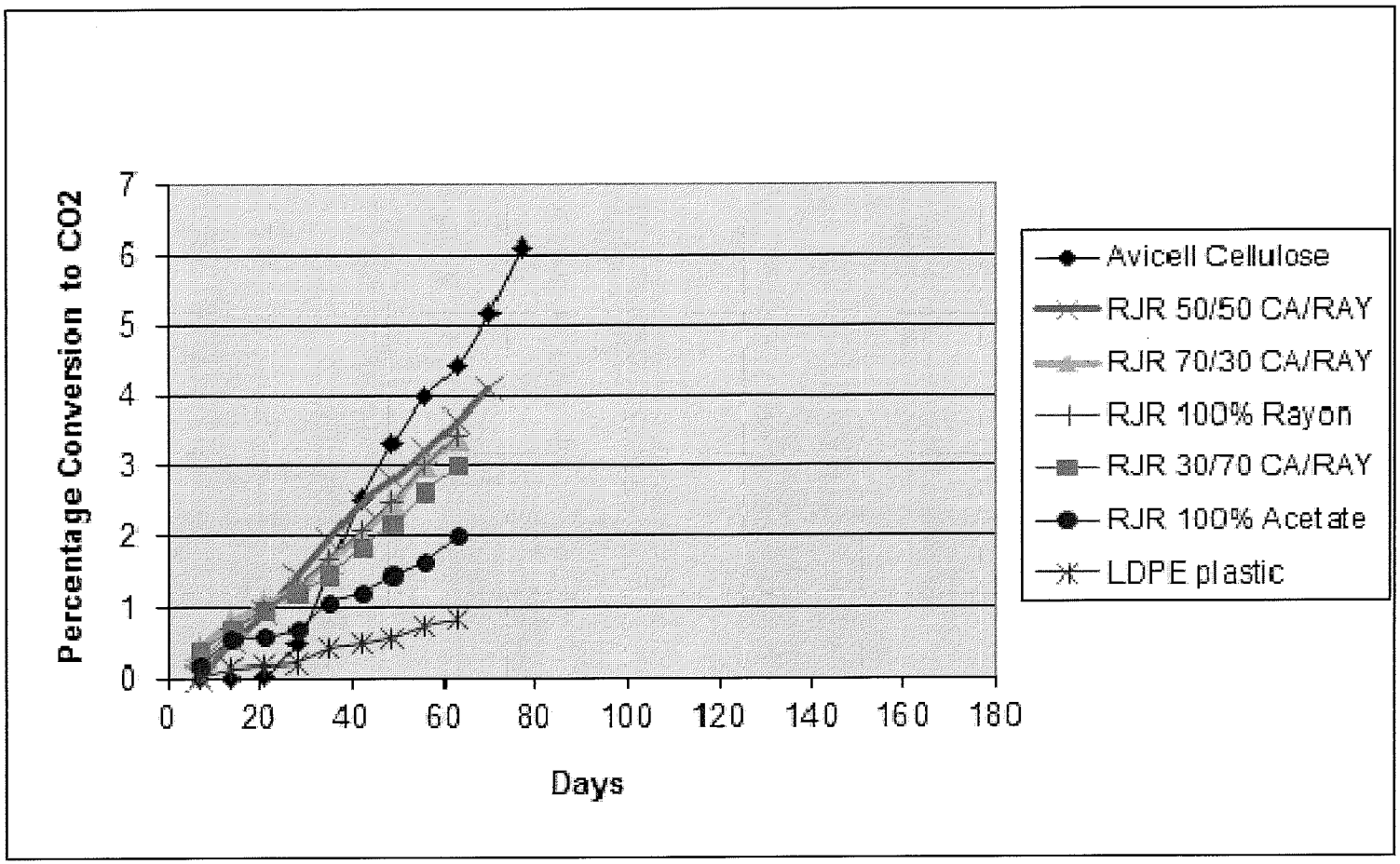
FIG. 6 illustrates biodegradation rates in a marine environment for filter material embodiments according to the invention.

The 60-day results are shown in FIG. 6. In the table RAY stands for rayon and CA stands for cellulose acetate. The mixed fiber tow with 50% cellulose acetate and 50% rayon biodegraded approximately 4%; the mixed fiber tow with 70% cellulose acetate and 30% rayon biodegraded approximately 3.3%; the tow with 100% rayon biodegraded approximately 3.3%; the mixed fiber tow with 30% cellulose acetate and 70% rayon biodegraded approximately 3.2%; the tow with 100% cellulose acetate biodegraded approximately 2%, the positive control of cellulose biodegraded approximately 6%, and the negative control LDPE plastic biodegraded approximately 1%. Thus, this data indicates that mixing rayon with cellulose acetate does increase the rate of biodegradation as compared to 100% cellulose acetate tow, and there may be some synergistic effect associated with certain CA/rayon combinations based on the fact that the 50/50 blend biodegraded at a higher rate than 100% rayon.

Example 3

Degradation Testing using Biochemical Methane Potential (BMP)

The BMP test is a measure of a material's susceptibility to anaerobic biodegradability in a landfill environment. In the BMP test, a small quantity of a material (~1 gm) is added to triplicate 160 ml serum bottles that are sealed. Each bottle contains (1) biological growth medium with required nutrients; (2) an inoculum of microorganisms that has been maintained on residential refuse (i.e., a lignocellulosic substrate); and (3) the test material. At each inoculation, 5 controls are monitored to measure background methane production associated with the inoculum. Samples are incubated at 37° C. and analyzed after 16, 31, 45 and 61 days to determine volume of methane in each bottle, although most of the methane is produced within 30 days. Results are reported as ml $CH_4$/dry gin of test material. See Wang, Y.-S., Byrd, C. S, and M. A. Barlaz, 1994, "Anaerobic Biodegradability of Cellulose and Hemicellulose in Excavated Refuse Samples," Journal of Industrial Microbiology, 13, p. 147-53. The BMP test is applied to various mixed fiber tows in the present example.

The BMP results and carbon conversion data are presented in Table 1 below. All data has been corrected for background methane associated with the inoculum. As illustrated by the results, the rayon exhibits anaerobic biodegradation while the cellulose acetate does not. Interestingly, when cellulose acetate is mixed with rayon, biodegradability increases relative to rayon alone. This suggests a synergistic interaction where either the presence of cellulose acetate stimulates additional rayon conversion or cellulose acetate is biodegradable when mixed with rayon. The % carbon conversion was calculated on the assumption that 1 mole of $CO_2$ is produced for each mole of $CH_4$ as only $CH_4$ is quantified. The 1:1 ratio is accurate for carbohydrates (e.g., cellulose) and will vary somewhat for other materials. In the table, CA refers to cellulose acetate and RAY refers to rayon.

TABLE 1

| Sample Description | % C | BMP (ml $CH_4$/dry gm) | RPD[a] | % C Conversion |
|---|---|---|---|---|
| 50/50 CA/RAY | 45.05 | 9.9 | 5.3 | 36.6 |
| 70/30 CA/RAY | 48.16 | 9.5 | 37.1 | 21.3 |
| 100% CA | 47.32 | 21.8 | 8.1 | 0.6 |
| 30/70 CA/RAY | 43.8 | 32.4 | 8.7 | 48.2 |
| 100% Rayon | 39.93 | 47.9 | 2.1 | 20.7 |

[a]RPD is the relative percent deviation with is the standard deviation divided by the mean and multiplied by 100%.

Example 4

Degradation Testing in Aerobic Environment

A test is conducted to assess aerobic biodegradability of rayon and cellulose acetate fibers, as well as three blends prepared according to Example 1 and a control, in an aerobic environment. The test is conducted using ISO Method 9408

"Ready Biodegradability" to measure the oxygen uptake required for biodegradation over time. The test plan consists of measuring oxygen uptake over a testing period using an RSA Pulse-Flow aerobic respirometer system to test each sample at an initial fiber concentration that provides about 100 mg/l of carbon (which is about 300 mg/l theoretical oxygen demand, THOD). The seed culture is aerobic mixed liquor from the Paul R. Noland Wastewater Treatment Plant in Fayetteville, Ark., USA. The tests temperature is 25° C. Nutrients, trace minerals, and buffer are added as indicated by the ISO 9408 protocol.

Figures 7A, 7B:
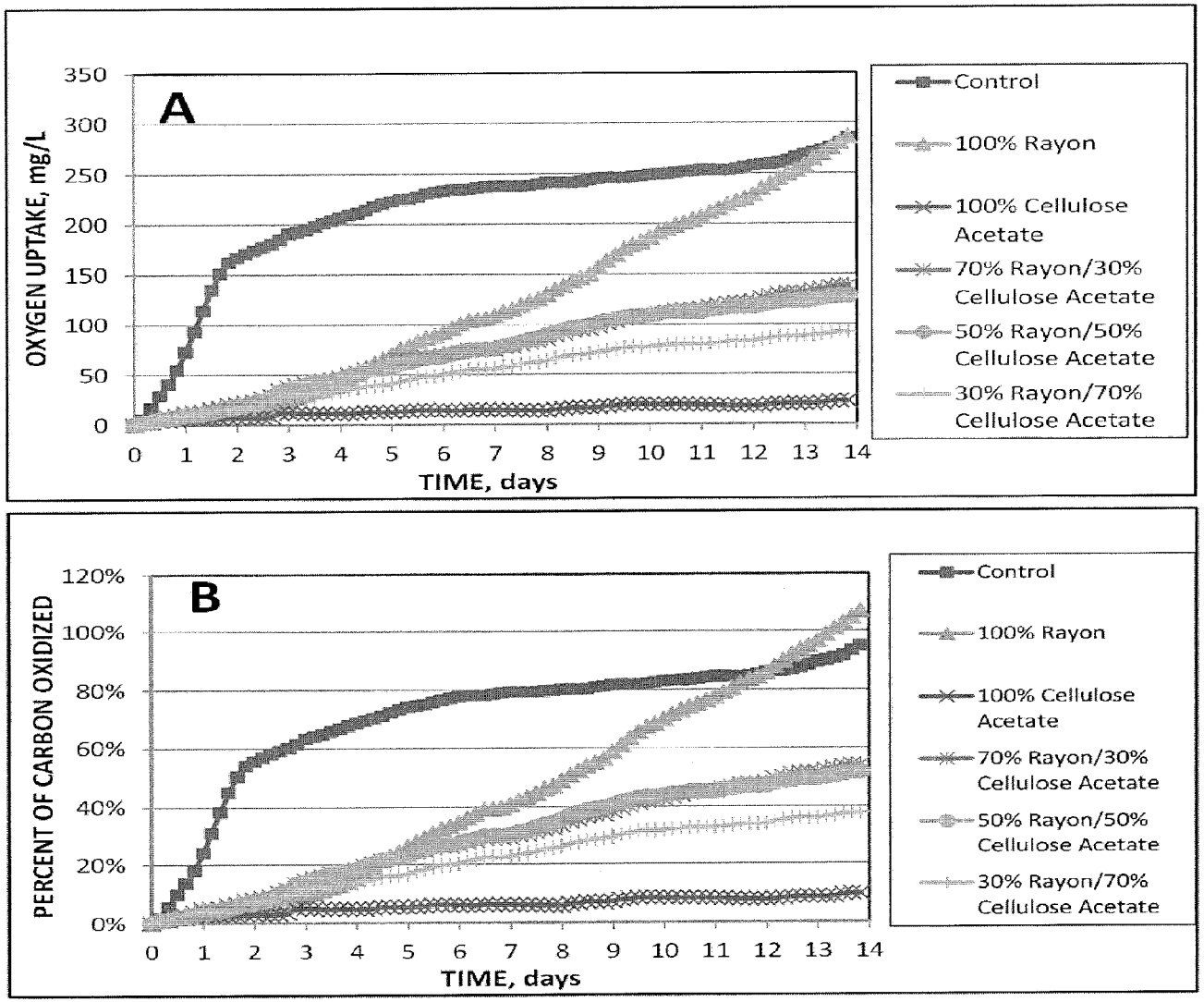
FIGS. 7A and 7B illustrate biodegradation rates in an aerobic environment for filter material embodiments according to the invention.

Data for the fiber tests through fourteen days of operation is shown in FIGS. 7A and 7B, which graph changes in oxygen uptake (7A) and percentage of carbon conversion (7B) over time. The shape of the oxygen uptake curves relative to that for the control and as a percentage of THOD indicates the biodegradability of the blended test fibers. These data show rapid biodegradation of the acetate control substrate and slower biodegradation of the fiber materials. The highest percent biodegradation for the fiber materials is with the 100% rayon sample. Biodegradation of the cellulose acetate fibers is very low. Biodegradation of the rayon/cellulose acetate blends is somewhat proportional to the percent rayon.

Example 5

Formation of Cigarette Filters Using Mixed Fiber Tows

Cigarette filters are prepared using conventional filter-making equipment using the three blends prepared according to Example 1 and a control (conventional cellulose acetate tow). The conventional tow and the three mixed fiber tows are plasticized with triacetin and filter rod segments are prepared and tested for pressure drop and hardness. Pressure drop values (in mm water) are measured using a Filtrona Quality Test Modules (QTM Series) available from Filtrona Instruments and Automation Ltd. A D61 Automatic Hardness Tester made by Sodim SAS can be used for hardness testing, where the instrument applies a constant compression load (300 g) to the sample for a fixed period of time (3 to 5 seconds) and digitally displays the compression value expressed as percent compression according to the formula: Hardness (%)=[(D−A)/D]×100, where D is the original mean diameter of the filter segment and A is the average compressed diameter of the filter segment.

Data for the tested filters is set forth in Table 2 below. The data includes triacetin weight percentage (as percentage of overall filter segment weight), weight of the tested filter segment, size of the tested filter segment, pressure drop of the tested filter segment, and hardness of the tested filter segment.

TABLE 2

| DESCRIPTION | TRIACETIN (%) | WEIGHT (g) | SIZE (mm) | PRESSURE DROP (mm) | Hardness DL (%) |
|---|---|---|---|---|---|
| 3.9 dpf and ~40K denier 70/30 CA/Rayon | 0.94 | 1.3114 | 24.44 | 436 | 90.1 |
| 3.9 dpf and ~40K denier 50/50 CA/Rayon | 0.67 | N/A | N/A | N/A | N/A |
| 3.9 dpf and ~40K denier 30/70 CA/Rayon | 1.30 | 0.8093 | 24.36 | 402 | 86.9 |
| Conventional CA Tow | 8.34 | 0.6814 | 24.49 | 398 | 95.0 |

The 30/70 CA/Rayon and 50/50 CA/Rayon blends are difficult to process on the equipment due to low strength. In particular, those blends do not have sufficient strength to allow the tow to be opened into a tow band of sufficient width for adequate plasticization. The 70/30 CA/rayon blend, while stronger than the other two mixed fiber tows, is able to be opened only to a tow band width of approximately 4 inches (compared to about 12 inches for conventional CA tow). Even with the relatively narrow tow band, the 70/30 CA/Rayon blend is able to be plasticized to an extent sufficient to generate a hardness level that is relatively close to conventional cigarette filters. This testing confirm that mixed fiber tows according to the invention can be made into cigarette filter segments that exhibit pressure drop and hardness characteristics that are similar to conventional cigarette filters.

As noted in Example 1, the fiber drawing process for the tested mixed fiber tows included use of a water bath. Rayon fibers are relatively hydrophilic. Accordingly, the use of a water bath likely has a significant negative effect on strength of the mixed fiber tow. It is believed that processing the mixed fiber tows in a manner that avoids excessive exposure to water may significantly enhance strength of the tow and improve how effectively such those materials can be processed using cigarette filter machines.

Many modifications and other aspects of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A method for forming a mixed fiber tow suitable for use in a filter element for a smoking article, the method comprising:

combining a first plurality of continuous filament cellulose acetate fibers with a second plurality of continuous filament regenerated cellulose fibers to form a mixed fiber blend;

drawing the mixed fiber blend to reduce the denier per filament of the fibers of the mixed fiber blend and form a drawn fiber blend;

crimping the drawn fiber blend to form a mixed fiber tow; and incorporating the mixed fiber tow into a filter element suitable for use in a smoking article, the incorporating step comprising blooming the mixed fiber tow, applying a plasticizer to the mixed fiber tow, and forming the mixed fiber tow into a filter rod, wherein the mixed fiber tow has a total denier in the range of from about 20,000 denier to about 80,000 denier, wherein the mixed fiber tow comprises at least about 50% by weight of the first plurality of cellulose acetate fibers and at least about 25% by weight of the second plurality of regenerated cellulose fibers, wherein the filter rod has a hardness of at least about 90%, and wherein the longitudinal axes of the first plurality of cellulose acetate fibers and the second plurality of regenerated cellulose fibers in the mixed fiber blend are disposed substantially parallel to each other.

2. The method according to claim 1, wherein the first plurality of cellulose acetate fibers and the second plurality of regenerated cellulose fibers are undrawn or partially drawn prior to said combining step.

3. The method according to claim 1, wherein the fibers of the mixed fiber blend are arranged such that the fibers of the first plurality of cellulose acetate fibers and the fibers of the second plurality of regenerated cellulose fibers are one of alternatingly disposed and substantially uniformly interspersed with respect to each other, over a cross-section of the mixed fiber blend.

4. The method according to claim 1, wherein the fibers of the mixed fiber blend are arranged such that one of the first plurality of cellulose acetate fibers and the second plurality of regenerated cellulose fibers is arranged to form a central core and the other of the first plurality of cellulose acetate fibers and the second plurality of regenerated cellulose fibers is arranged perimetrically about the central core, with respect to a cross-section of the mixed fiber blend such that the cellulose acetate fibers can be plasticized discretely from the regenerated cellulose fibers.

5. The method according to claim 1, wherein the mixed fiber tow has a total denier in the range of from about 30,000 denier to about 60,000 denier.

6. The method according to claim 1, wherein the mixed fiber tow has a dpf in the range of about 3 to about 5.

7. A method for forming a filter element for a smoking article, the method comprising:

receiving a mixed fiber tow comprising a blend of a first plurality of drawn and crimped continuous filament cellulose acetate fibers and a second plurality of drawn and crimped continuous filament regenerated cellulose fibers, the mixed fiber tow having a total denier in the range of from about 20,000 denier to about 80,000 denier; and processing the mixed fiber tow to provide a filter element suitable for incorporation into a smoking article, the processing step comprising blooming the mixed fiber tow, applying a plasticizer to the mixed fiber tow, and forming the mixed fiber tow into a filter rod, wherein the mixed fiber tow comprises at least about 50% by weight of the first plurality of cellulose acetate fibers and at least about 25% by weight of the second plurality of regenerated cellulose fibers, wherein the filter rod has a hardness of at least about 90%, and wherein the longitudinal axes of the first plurality of cellulose acetate fibers and the second plurality of regenerated cellulose fibers in the mixed fiber tow are disposed substantially parallel to each other.

8. The method according to claim 7, wherein the fibers of the mixed fiber tow are arranged such that the fibers of the first plurality of cellulose acetate fibers and the fibers of the second plurality of regenerated cellulose fibers are one of alternatingly disposed and substantially uniformly interspersed with respect to each other, over a cross-section of the mixed fiber tow.

9. The method according to claim 7, wherein the fibers of the mixed fiber tow are arranged such that one of the first plurality of cellulose acetate fibers and the second plurality of regenerated cellulose fibers is arranged to form a central core and the other of the first plurality of cellulose acetate fibers and the second plurality of regenerated cellulose fibers is arranged perimetrically about the central core, with respect to a cross-section of the mixed fiber tow such that the cellulose acetate fibers can be plasticized discretely from the regenerated cellulose fibers.

10. The method according to claim 7, wherein the mixed fiber tow has a total denier in the range of from about 30,000 denier to about 60,000 denier.

11. A filter element suitable for use in a smoking article, the filter element in the form of a plasticized filter rod comprising a mixed fiber tow comprising a blend of a first plurality of drawn and crimped continuous filament cellulose acetate fibers and a second plurality of drawn and crimped continuous filament regenerated cellulose fibers, the mixed fiber tow having a total denier in the range of from about 20,000 denier to about 80,000 denier, wherein the mixed fiber tow comprises at least about 50% by weight of the first plurality of cellulose acetate fibers and at least about 25% by weight of the second plurality of regenerated cellulose fibers, and wherein the filter rod has a hardness of at least about 90%.

12. The filter element according to claim 11, wherein the mixed fiber tow has a total denier in the range of from about 30,000 denier to about 60,000 denier.

13. The filter element according to claim 11, wherein the filter element exhibits a degradation rate that is at least about 50% faster than that of a traditional cellulose acetate filter element.

14. The filter element according to claim 11, wherein the fibers of the mixed fiber tow are arranged such that the fibers of the first plurality of cellulose acetate fibers and the fibers of the second plurality of regenerated cellulose fibers are one of alternatingly disposed and substantially uniformly interspersed with respect to each other, over a cross-section of the mixed fiber tow.

15. The filter element according to claim 11, wherein the fibers of the mixed fiber tow are arranged such that one of the first plurality of cellulose acetate fibers and the second plurality of regenerated cellulose fibers is arranged to form a central core and the other of the first plurality of cellulose acetate fibers and the second plurality of regenerated cellulose fibers is arranged perimetrically about the central core, with respect to a cross-section of the mixed fiber tow such that the cellulose acetate fibers can be plasticized discretely from the regenerated cellulose fibers.

16. A cigarette comprising a rod of smokable material and a filter element according to claim 11 attached thereto.

* * * * *